US005970568A

United States Patent [19]

Mulcahy, Sr.

[11] Patent Number: 5,970,568

[45] Date of Patent: Oct. 26, 1999

[54] BIFURCATED ROLLER WITH PAINT TRAY DIVIDER RECEIVER AND INTEGRAL FRAME

[75] Inventor: Gary T. Mulcahy, Sr., Oakdale, Minn.

[73] Assignee: Wagner Spray Tech Corporation, Minneapolis, Minn.

[21] Appl. No.: 09/018,927

[22] Filed: Feb. 5, 1998

[51] Int. Cl.[6] ..... B05C 17/02

[52] U.S. Cl. ..... 15/230.11; 15/257.06; 492/13; 492/19; D4/122

[58] Field of Search ..... 15/230.11, 257.06; 492/13, 19; D4/122, 123

[56] References Cited

U.S. PATENT DOCUMENTS

| | | | |
|---|---|---|---|
| Re. 29,311 | 7/1977 | Ritter | 401/188 R |
| D. 220,850 | 6/1971 | Davis | D4/123 |
| D. 248,335 | 6/1978 | Cooke | D32/53.1 |
| D. 286,458 | 10/1986 | Pages | D32/53.1 |
| D. 327,755 | 7/1992 | Boyer | D32/53.1 |
| 2,321,511 | 6/1943 | Piercy | 15/23.11 |
| 2,371,948 | 3/1945 | Bergmann | 15/230.11 |
| 2,402,346 | 6/1946 | Rosenlund | 15/257.06 |
| 2,467,010 | 4/1949 | Coley | 401/218 |
| 2,630,592 | 3/1953 | Sultanik et al. | 401/218 |
| 2,680,873 | 6/1954 | Erns | 15/235 |
| 2,693,893 | 11/1954 | Rice et al. | 492/13 |
| 2,735,128 | 2/1956 | Adams | 15/230.11 |
| 2,799,884 | 7/1957 | Bedford | 15/230.11 |
| 2,838,781 | 6/1958 | Molle | 15/257.06 |
| 2,881,461 | 4/1959 | Parker | 15/230.11 |
| 2,955,309 | 10/1960 | Brown, Jr. | 15/119.2 |
| 3,102,327 | 9/1963 | Wiegand | 492/19 |
| 3,554,659 | 1/1971 | Stokes | 401/197 |
| 3,562,837 | 2/1971 | Baaginski et al. | 15/230.11 |
| 3,609,049 | 9/1971 | Smyth | 401/118 |

(List continued on next page.)

FOREIGN PATENT DOCUMENTS

| | | | |
|---|---|---|---|
| 476613 | 8/1951 | Canada . | |
| 2489175 | 3/1982 | France . | |
| 2332677 | 1/1974 | Germany . | |
| 3616114 | 11/1987 | Germany | 15/230.11 |
| 9002017 | 4/1991 | Netherlands . | |
| 80213 | 5/1952 | Norway | 15/230.11 |
| 191483 | 9/1937 | Switzerland | 492/13 |
| 694228 | 12/1979 | U.S.S.R. | 15/230.11 |
| 2172820 | 10/1986 | United Kingdom | 15/230.11 |

OTHER PUBLICATIONS

Harrington et al., "Tri–Roller Technique," *Color: A Stroke of Brilliance,* Copyright 1993, 1995, pp. 104–107, Benjamin Moore & Co., N.J.

Color A Stroke of Brilliance, A Guide to Color & Decorating with Paint by Lesie Harrington, Joan Mackie, Copyright 1993 by Benjamin Moore & Co. Ltd. 6 pages.

*Primary Examiner*—Mark Spisich
*Attorney, Agent, or Firm*—Faegre & Benson LLP

[57] ABSTRACT

The present bifurcated roller tool includes a pair of rollers which rotate independently of the other. The rollers are rotatably engaged on a distal frame portion which has a pair of roller engaging portions. The roller engaging portions are separated from each other via a V-shaped medial frame section. The medial frame section defines a receiver which permits the reception of a paint tray divider. The paint tray divider separates two receptacle portions of a paint tray. A frame for the bifurcated roller includes an intermediate frame portion leading from a handle to one of the roller engaging portions of the distal frame portion. The other of the roller engaging portions includes a free outer end and it is over this end that roller covers are slid off the roller mounts and other roller covers slide onto their respective roller mounts. The roller cover which engages the roller mount proximate to the intermediate frame portion slides over the medial frame portion and onto and off the other of the roller mount when it is to be replaced or cleaned. The intermediate frame portion and roller engaging portions define sections of a rod such that the frame for the bifurcated roller is integral and one-piece.

13 Claims, 5 Drawing Sheets

U.S. PATENT DOCUMENTS

| | | | |
|---|---|---|---|
| 3,649,986 | 3/1972 | Dahlund | 15/230.11 |
| 3,745,624 | 7/1973 | Newman | 492/19 |
| 3,970,396 | 7/1976 | Brady | 401/208 |
| 3,986,226 | 10/1976 | Roe | 15/230.11 |
| 4,000,537 | 1/1977 | Woo | 15/230.11 |
| 4,010,866 | 3/1977 | McClane | 220/570 |
| 4,029,011 | 6/1977 | Kurner | 101/330 |
| 4,102,468 | 7/1978 | Goldman | 220/570 |
| 4,335,484 | 6/1982 | Ridge et al. | 15/230.11 |
| 4,404,703 | 9/1983 | Woodall, Jr. et al. | 15/230.11 |
| 4,630,952 | 12/1986 | Elbaum | 15/118 |
| 4,872,236 | 10/1989 | Thompson | 15/118 |
| 4,930,179 | 6/1990 | Wright et al. | 15/230.11 |
| 5,139,139 | 8/1992 | Goetz | 206/229 |
| 5,169,022 | 12/1992 | Elliott et al. | 220/570 |
| 5,325,958 | 7/1994 | Arasim | 206/1.8 |
| 5,386,611 | 2/1995 | Kim | 15/230.11 |
| 5,412,832 | 5/1995 | Irven | 15/230.11 |
| 5,437,593 | 8/1995 | Gustavsen | 492/13 |
| 5,473,791 | 12/1995 | Holcomb et al. | 15/230.11 |
| 5,493,751 | 2/1996 | Misiukowiec et al. | 15/257.06 |
| 5,509,169 | 4/1996 | Drucker | 15/257.06 |
| 5,533,228 | 7/1996 | Jarecki et al. | 15/257.06 |
| 5,539,948 | 7/1996 | McCauley et al. | 15/105 |
| 5,571,562 | 11/1996 | Wakat | 427/280 |
| 5,577,291 | 11/1996 | Myers et al. | 15/230.11 |
| 5,611,100 | 3/1997 | Zigelboim et al. | 15/230.11 |
| 5,693,141 | 12/1997 | Tramont | 118/211 |
| 5,713,095 | 2/1998 | Wakat | 15/230.11 |

BIFURCATED ROLLER WITH PAINT TRAY DIVIDER RECEIVER AND INTEGRAL FRAME

The present invention relates generally to paint rollers, more particularly to bifurcated paint rollers, and specifically to bifurcated paint rollers which cooperate with bifurcated paint trays.

BACKGROUND OF THE INVENTION

The bifurcated roller shown by U.S. Pat. No. 5,713,095 includes several drawbacks. For example, the roller is manufactured from two conventional rollers, using two conventional frames. Prior to welding the two conventional frames together, one of the conventional frames is cut below the handle and such handle is thrown away, contributing to the expense of the bifurcated roller.

Another drawback is that this bifurcated roller includes an excessively long open space or slot between the rollers. This length wastes the framing rods which form the slot. Further, the slot tends to undesirably act, especially if sticky from paint, as a receptor for newspapers and tape.

SUMMARY OF THE INVENTION

A feature of the present invention is the provision, in a bifurcated roller, of a medial frame section extending between the inner ends of the rollers wherein the medial frame section is at least partially offset from the axis of the rollers and forms a shallow receiver. The receiver includes a depth sufficiently great to permit some reception of a divider of a paint tray where the divider separates two receptacle portions formed in the paint tray. The receiver includes a depth sufficiently shallow to permit a roller cover to be slid thereover.

More specifically, the frame of the bifurcated roller includes a handle portion and an intermediate portion extending from the handle and leading into one end of a distal end portion. The distal end portion includes a pair of roller engaging portions, with the medial frame section extending between the roller engaging portions. On each of the roller engaging portions is engaged one of the rollers. Each of the rollers includes a roller cover and a roller mount. One roller mount is rotatably engaged on each of the roller engaging portions, and a roller cover is frictionally slideable on and off its respective roller mount.

The innermost roller cover, which is located adjacent where the intermediate frame portion joins the distal end portion, is removed by sliding it off its roller mount, over the medial section, and over the roller mount of the other roller. It is preferable that the diameter of such roller cover, as well as both roller covers, be at least as great as twice the depth of the shallow receiver.

Another feature of the present invention is that the frame is integral. The proximal end portions, intermediate portion, and distal end portion, including the roller engaging portions and V-shaped medial section, are formed from one-piece.

An advantage of the present invention is that the bifurcated roller tool uses less material and is thus less expensive.

Another advantage is that the length of the slot is minimized. The bifurcated roller tool catches less newspapers and tape.

Another advantage is that the bifurcated roller tool has an appearance similar to that of a conventional roller.

These and further objects and advantages of the present invention will become clearer in light of the following detailed description of the illustrative embodiments of this invention described in connection with the drawings.

Figure 1:
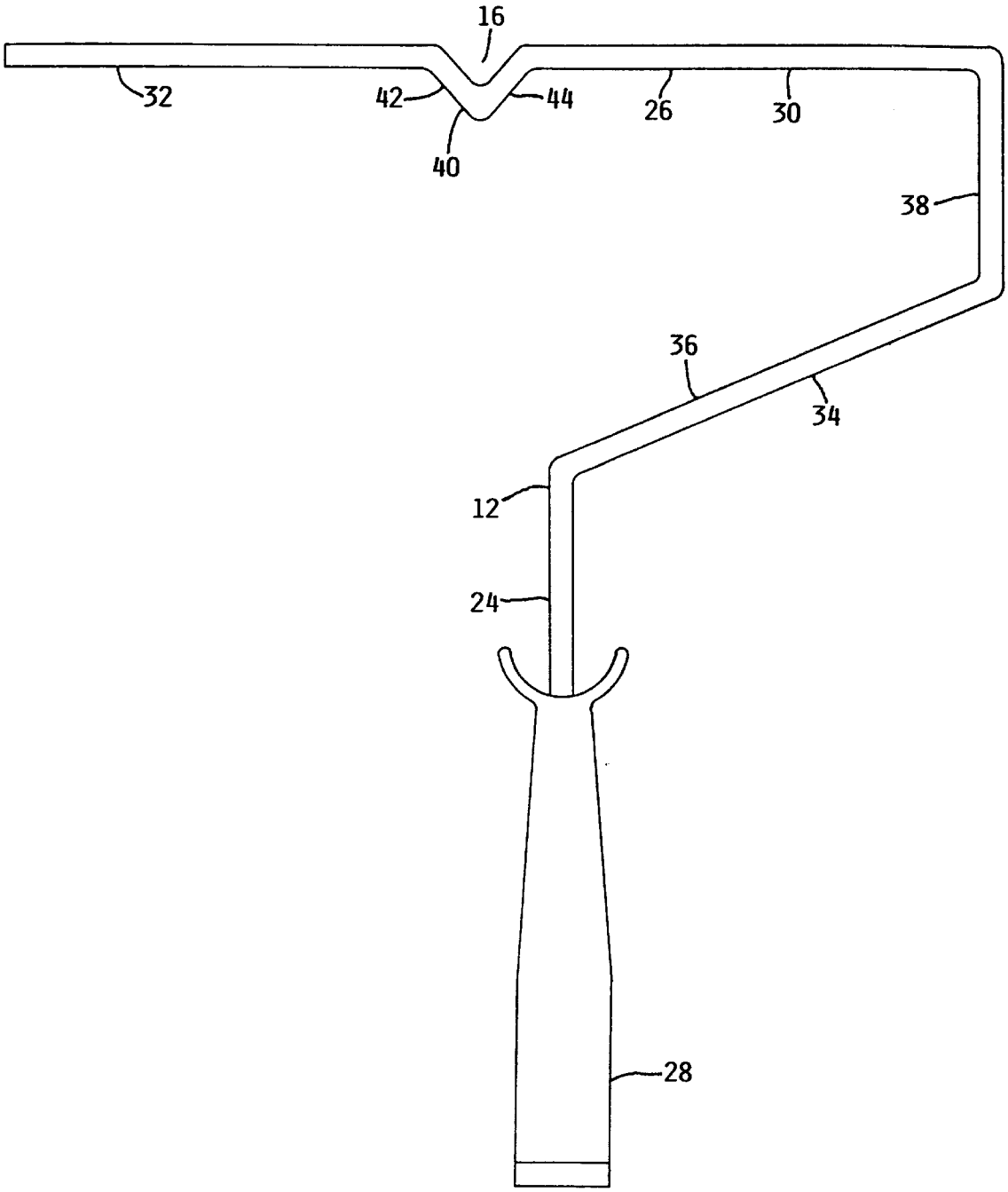
FIG. 1 shows a top view of the frame for the present bifurcated roller.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "inner", and "outer", and similar terms are used herein, it should be understood that these terms have reference only to the structure shown in the drawings as it would appear to a person viewing the drawings and are utilized only to facilitate describing the preferred embodiments.

DETAILED DESCRIPTION

Figure 4:
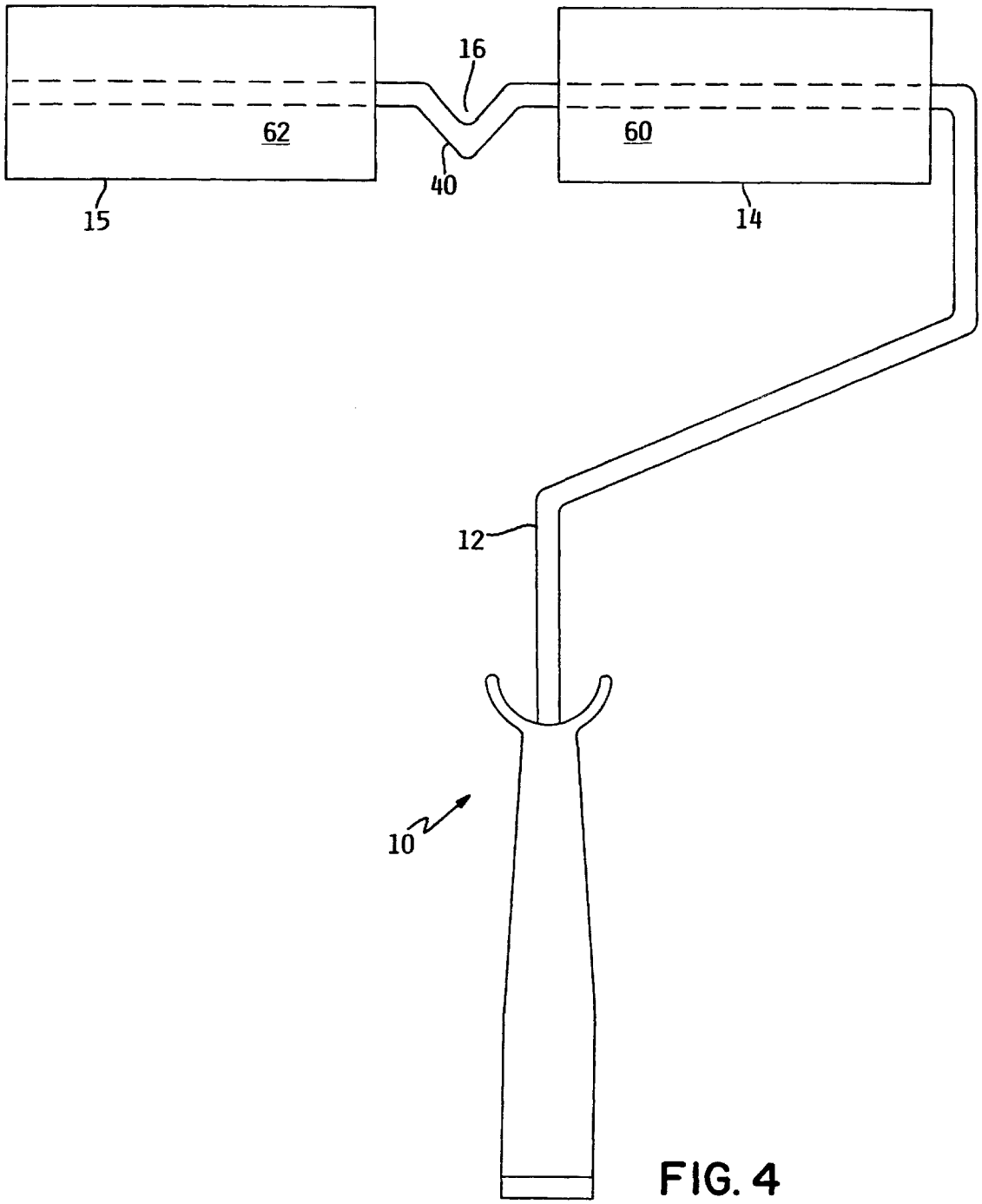
FIG. 4 shows a top view of the bifurcated roller with both roller covers having been slid onto their respective mounts.
Figure 5:
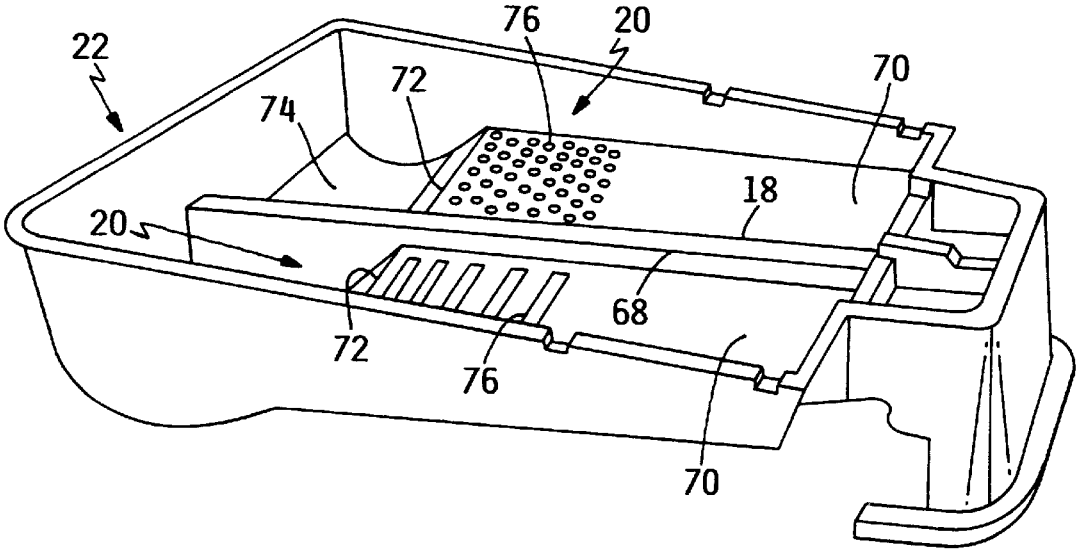
FIG. 5 shows a paint tray for use with the present bifurcated roller wherein a relatively low divider is used between relatively shallow paint tray receptacles.

As shown in FIG. 4, the present bifurcated roller tool is generally indicated by the reference numeral 10. The roller tool 10 includes a frame 12, inner and outer rollers 14 and 15, and a receptor 16 formed by the frame 12. The receptor 16 is formed between the bifurcated rollers 14 and 15 for receiving a divider 18 separating two paint tray receptacles 20 formed in a paint tray 22, as shown in FIG. 5.

More specifically, as shown in FIG. 1, the frame 12 of the bifurcated roller tool 10 includes a proximal end portion 24 and a distal end portion 26. The proximal end portion 24 includes a handle 28 mounted thereon. The distal end portion 26 includes a pair of roller engaging inner and outer distal end rod sections 30, 32. Rod sections 30 and 32 are coaxial.

Disposed between the proximal end portion 24 and distal end portion 26 is an intermediate frame rod portion 34. Frame rod portion 34 includes an oblique section 36 and a roller end bypass section 38 which integrally leads into inner distal end rod section 30 at a right angle. It should be noted that proximal end portion 24 preferably runs generally parallel to roller end bypass section 38 so as to also generally extend at a right angle to the roller engaging rod sections 30 and 32 and so as to also generally extend at a right angle to the rollers 14 and 15.

The frame 12 further includes a medial frame rod section 40 disposed between the roller engaging rod sections 30 and 32. Medial frame rod section 40 forms the receiver 16. Medial frame rod section 40 is formed in the shape of a V so as to include obliquely extending integral rod parts 42 and 44. Rod parts 42 and 44 extend away from the axis of the rollers 14 and 15.

It should be noted that proximal frame portion 24 extends in a direction which is preferably offset relative to the receiver 16. However, if desired, the proximal frame portion 24 may extend in a direction which is generally aligned with the receiver 16.

Figures 2, 3:
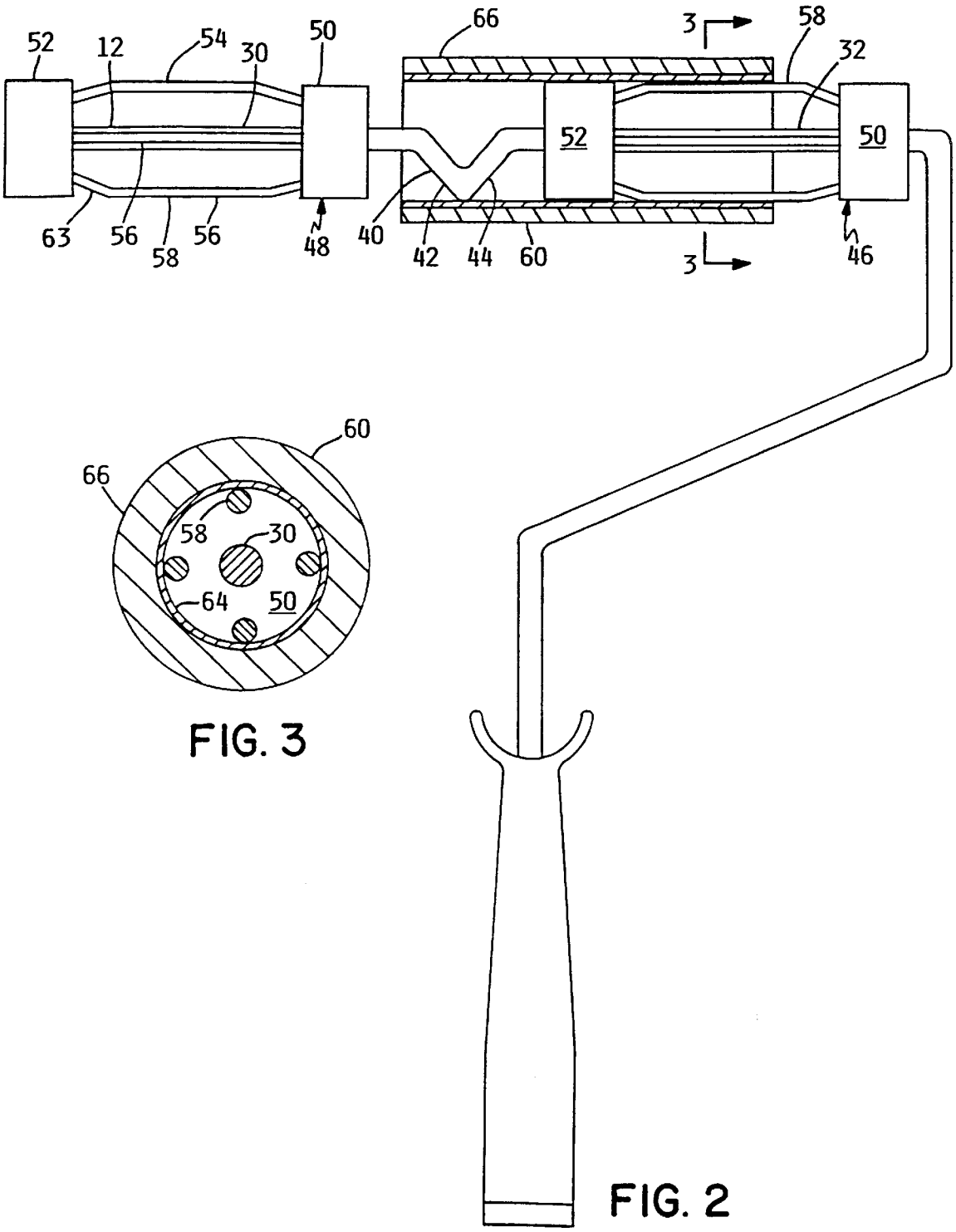
FIG. 2 shows the frame of FIG. 1 having the mounts for the roller covers and further shows the inner roller cover being slid over the paint tray divider receiver and onto its inner mount.
FIG. 3 is a section at lines 3—3 of FIG. 2.

As shown in FIGS. 2 and 3, the rollers 14 and 15 include respective inner and outer roller mounts 46 and 48. Each of the roller mounts 46 and 48 is rotatably journaled on its respective distal end section 30, 32 such that roller mounts 46 and 48 are fixed at a respective axial position so as to prevent sliding from side to side in the axial direction. Inner roller mount 46, prior to being rotatably journaled at its position, may be slid onto the frame 12 via the free or outer distal rod section 32, slid onto and along each of the rod parts 42 and 44 of the medial frame rod section 40, and onto its inner distal rod section 30. Each of the roller mounts 46, 48 includes a pair of generally cylindrical ends 50, 52 and a cage 54 engaged to and between the ends 50, 52. Each of the cages 54 includes a set of four bars 56. Each of the bars 56 includes a generally linearly extending portion 58 which engages one of the roller covers 60, 62. Each of the bars 56 further includes a portion 63 angling in from the linear portion 58 and being set in one of the cylindrical ends 50, 52. The diameter of the cylindrical ends 50 and 52 is generally equal to the distance between radially opposite linear bar portions 58 and is further generally equal to the inside diameter of the roller covers 60, 62.

Each of the roller covers 60, 62 includes a base 64 and a nap 66. Base 64 is a cylindrical tube and includes an inside diameter, as noted above, which is generally equal to the outside diameter of the cylindrical ends 50, 52 of the roller mounts 46 and 48 such that the base 64 frictionally fits upon and is frictionally slideable over the cylindrical ends 50, 52. The inner diameter of the base 64 is further generally equal to the distance between radially opposite bar linear portions 58 such that the roller covers 60 and 62 frictionally engage and frictionally slide over their respective cages 54 and such that the inner roller cover 60 slides over both cages 54.

For picking up and spreading of paint, the naps 66 may be of the conventional type or may be of the patterned or design type. If of the patterned or design type, such a pattern or design may be embossed therein. As to the patterned or design type of nap, U.S. Pat. No. 5,713,095 is hereby incorporated by reference in its entirety.

It should be noted that the inside diameter of the roller cover 60, as well as roller cover 62, is generally equal to twice the height of the V-shaped medial frame section 40. As such, the inner roller cover 62 is slideable over the roller mount 48, over the V-shaped medial frame section 40, and onto its roller mount 46.

As indicated above and as shown in FIG. 5, the paint tray 22 includes the pair of relatively shallow paint tray receptacles 20 which are separated by a relatively low divider 18. The height of one portion 68 of the divider 18 is preferably generally equal to the depth of the receiver 16 and the radius of roller 14 or 15. This divider portion 68 extends from a proximal floor portion 70 of the paint tray 22 to a drop off portion 72. The drop off portion 72 leads into a deeper portion 74 into which the rollers 14 and 15 are prevented from being fully dipped by the medial V-shaped frame section 40. However, the medial V-shaped frame section 40 is sufficiently deep to permit the naps 66 of the rollers 14, 15 to rollingly engage roughened floor portions 76 so as to drive excess paint off the rollers 14, 15.

Figure 6:
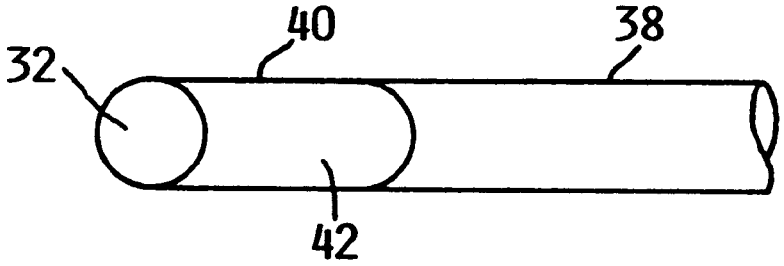
FIG. 6 shows an elevation partial view of the roller frame of FIG. 1 and in particular shows the preferred direction for extension of the medial frame section.

FIG. 6 indicates that the medial frame section 40 may extend in generally the same plane as intermediate frame portion 38. FIG. 1 shows this direction of extension and further shows that the entire frame 12 lies in generally a common plane. This is the preferred embodiment where the user extends the tool 10 directly downwardly into the paint tray 22, such as where the paint tray 22 is on the floor.

Figure 7:
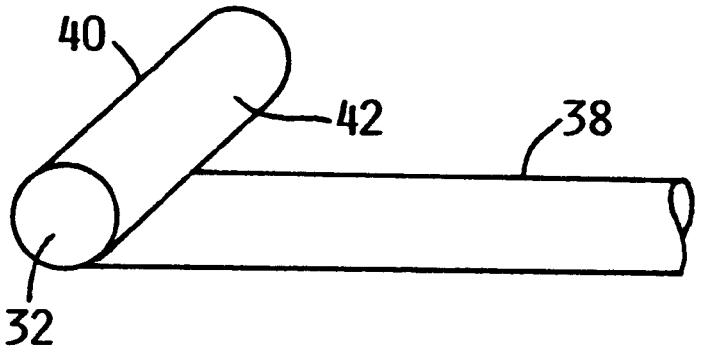
FIG. 7 is an elevation partial view similar to that of FIG. 6 and shows another direction of extension for the medial frame section.

FIG. 7 shows that the medial frame section 40 may extend obliquely relative to frame section 38 and therefore obliquely to the plane in which the roller engaging portions 30, 32, the intermediate frame portion 34, and the proximal end portion 24 lie. A user may prefer this embodiment where the bifurcated roller tool 10 is inserted into the paint tray 22 at generally a 45 degree angle, such as where the paint tray 22 is on a bench.

Figure 8:
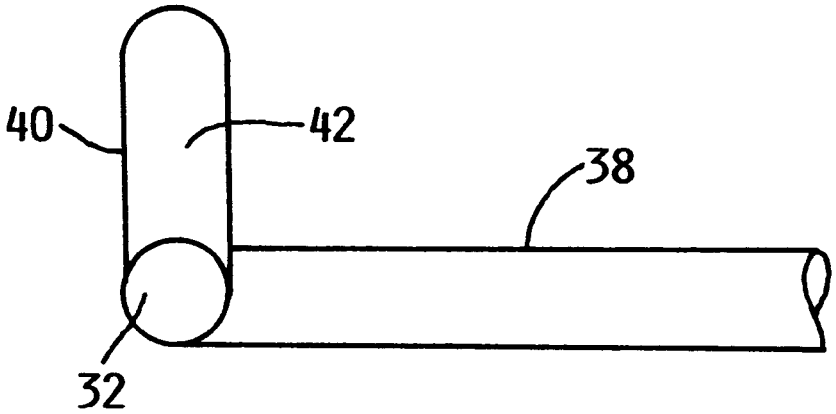
FIG. 8 is an elevation partial view similar to that of FIG. 6 and shows yet another direction of extension for the medial frame section.

FIG. 8 shows that the medial frame section 40 may extend at a right angle relative to frame section 38 and therefore at a right angle to the plane in which the roller engaging portions 30, 32, the intermediate frame portion 34, and the proximal end portion 24 lie. A user may prefer this embodiment where the paint tray 22 is on a table.

As to operation of the bifurcated roller tool 10 and the paint tray 22, U.S. Pat. No. 5,713,095 (issued Feb. 3, 1998) is hereby incorporated by reference in its entirety. Generally, paints of different colors are poured into the separated paint receptacles 20. The rollers 14 and 15 are then dipped into the respective paint receptacles 20, rolled against the rough portions 76 to drive off excess paint, and then rolled on a surface such that a paint stripe painted by one roller is crossed over with the other roller to form a rag rolling or sponge painting effect.

It should be noted that some roller covers are at least partially resilient and, when squeezed, form an elongate opening, somewhat elliptical in shape. With such roller covers, a receiver of a greater depth may be formed as such roller covers may slide over such a receiver when squeezed to form such elongate opening.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A bifurcated roller comprising:

a) a frame, with the frame comprising a proximal end portion and a distal end portion;

b) at least a pair of rollers respectively mounted on the distal end portion, with each of the rollers comprising a roller mount and a roller cover for picking up and spreading paint, with each of the rollers rotatable about an axis, with each of the rollers rotating independently of the other, with each of the rollers further comprising inner ends which are spaced from each other; P1 c) wherein the distal end portion of the frame comprises at least a pair of roller engaging portions and a medial section between the roller engaging portions, with the medial section having a subsection extending away from one of the roller engaging portions and another subsection extending away from the other roller engaging portion, with the subsections further extending away from the axis and engaging each other at a location offset relative to the axis; and d) an intermediate frame portion engaged between the proximal end portion and one of the roller engaging portions of the distal end portion such that one roller cover and roller mount are proximate to the intermediate frame portion and such that the other roller cover and roller mount are distal to the intermediate frame portion, wherein the roller covers are slideable off their respective roller mounts, wherein said proximate roller cover is slideable over the roller mount distal to the intermediate frame portion when said distal roller mount lacks said distal roller cover, and wherein said proximate roller cover is slideable over the medial section to be slideable onto and off its proximate roller mount.

2. The bifurcated roller of claim 1, wherein the subsections converge linearly toward each other.

3. The bifurcated roller of claim 1, and further comprising, in combination, a paint tray comprising two receptacle portions, with the receptacle portions being separated by a divider, and with the rollers being respectively dippable in paint in the receptacle portions, and with the medial section at least partially receiving the divider such that the rollers are dippable to beyond their respective axis in the receptacle portions.

4. The bifurcated roller of claim 1, wherein the proximal end portion extends in a direction which is offset from the medial section.

5. The bifurcated roller of claim 1, wherein the frame comprises a rod, with the proximal end portion, roller engaging portions, and medial section being portions of the rod.

6. The bifurcated roller of claim 1, wherein the roller engaging portions and proximal end portion define a plane and wherein the medial section lies generally in the plane.

7. The bifurcated roller of claim 1, wherein the roller engaging portions and proximal end portion define a plane and wherein the medial section lies obliquely to the plane.

8. The bifurcated roller of claim 1, wherein the roller engaging portions and proximal end portion define a plane and wherein the medial section lies at generally a right angle to the plane.

9. The bifurcated roller of claim 1, wherein a distance from the location at which the subsections engage each other to the axis is less than the radius of the roller.

10. A bifurcated roller comprising:

a) a frame, with the frame comprising a proximal end portion and a distal end portion;

b) at least a pair of rollers respectively mounted on the distal end portion with each of the rollers comprising a roller mount and a roller cover for picking up and spreading paint, with each of the rollers rotatable about an axis, with each of the rollers rotating independently of the other, with each of the rollers further comprising inner ends which are spaced from each other;

c) wherein the distal end portion of the frame comprises at least a pair of roller engaging portions and a medial section between the roller engaging portions, with the medial section having a subsection extending away from one of the roller engaging portions and another subsection extending away from the other roller engaging portion, with the subsections further extending away from the axis and engaging each other at a location offset relative to the axis; and d) with each of the roller mounts rotatably engaged to one of the roller engaging portions of the frame, and with each of the roller covers being slideably engagable with one of the roller mounts, with at least one of the roller covers being slideable over the medial section of the frame and slideable over each of the roller mounts.

11. The bifurcated roller of claim 10, wherein the roller cover which is slideable over the medial section includes a diameter at least as great as twice the height of the medial section.

12. A bifurcated roller comprising:

a) a frame, with the frame comprising a proximal end portion, an intermediate frame portion, and a distal end portion, with the distal end portion comprising at least a pair of inner and outer roller engaging portions, and with the intermediate frame portion extending between the proximal end portion and the inner roller engaging portion;

b) at least a pair of inner and outer rollers respectively mounted on the inner and outer roller engaging portions of the frame, with each of the rollers comprising a roller mount and a roller cover, with one of the roller mounts being rotatably engaged to the inner roller engaging portion and the other roller mount being rotatably engaged to the outer roller engaging portion, with each of the roller covers picking up and spreading paint, with each of the rollers rotatable about an axis defined by the roller engaging portions, with each of the rollers rotating independently of the other, with each of the rollers further comprising inner ends which are spaced from each other;

c) wherein each of the roller covers is frictionally and slideably engaged on its respective roller mount, with the roller cover for the roller mount for the inner roller engaging portion being slideable over the roller mount for the outer roller engaging portion to slide said roller cover onto the roller mount for the inner roller engaging portion and to remove said roller cover from the roller mount for the inner roller engaging portion; and d) wherein the distal end portion of the frame further comprises a medial section between the roller engaging portions, with the medial section comprising subsections extending away from the roller engaging portions of the frame and engaging each other at a location offset from the axis such that the medial section forms a receptor and such that the roller cover of the inner roller may be slid over the receptor.

13. A bifurcated roller in combination with a paint tray, comprising:

a) the bifurcated roller, with the bifurcated roller comprising:

i) a frame, with the frame comprising a proximal end portion and a distal end portion;

ii) at least a pair of rollers respectively mounted on the distal end portion, with each of the rollers picking up and spreading paint, with each of the rollers rotatable about an axis, with each of the rollers rotating independently of the other, with each of the rollers further comprising inner ends which are spaced from each other, with each of the rollers having a radius; and iii) wherein the distal end portion of the frame comprises at least a pair of coaxial roller engaging portions and a medial section between the roller engaging portions, with the medial section having a subsection extending away from one of the roller engaging portions and another subsection extending away from the other roller engaging portion, with the subsections further extending away from the axis and engaging each other at a location offset relative to the axis such that the medial section forms a receptor, with a distance from the axis to the location where the subsections engage each other being less than said radius of said rollers; and b) the paint tray, with the paint tray comprising:

i) two receptacle portions, with the receptacle portions being separated by a divider, and with the rollers being respectively dippable in paint in the receptacle portions, and with the receptor of the medial section at least partially receiving the divider such that the rollers are dippable to a location beyond their respective axis in the receptacle portions.

* * * * *